US006796864B1

(12) United States Patent
Schoos

(10) Patent No.: US 6,796,864 B1
(45) Date of Patent: Sep. 28, 2004

(54) ESCAPE DEVICE FOR ANIMAL IN SWIMMING POOL

(75) Inventor: Paul Johannes Schoos, 19 Jocelyn Ct., Hampton, NJ (US) 08827

(73) Assignee: Paul Johannes Schoos, Hampton, NJ (US)

( * ) Notice: Subject to any disclaimer, the term of this patent is extended or adjusted under 35 U.S.C. 154(b) by 46 days.

(21) Appl. No.: 10/418,813

(22) Filed: Apr. 19, 2003

(51) Int. Cl.[7] ..... B63C 9/00
(52) U.S. Cl. ..... 441/80; 119/706
(58) Field of Search ..... 441/80, 83, 129; 114/362; 14/75; 119/416, 452, 706, 843, 847, 849; 4/499, 503, 504

(56) References Cited

U.S. PATENT DOCUMENTS 3,711,873 A * 1/1973 Katzman ..... 4/503
3,891,053 A * 6/1975 Burton ..... 182/97
4,109,325 A * 8/1978 Shuff ..... 4/499
4,178,690 A * 12/1979 Aine ..... 4/499
4,972,540 A * 11/1990 Phelps ..... 119/847
5,377,623 A * 1/1995 Parr ..... 119/221
5,829,380 A * 11/1998 Smith ..... 114/362
5,832,547 A * 11/1998 Burroughs ..... 4/504
6,321,689 B1 * 11/2001 Fulmer ..... 441/80
6,574,804 B1 * 6/2003 Boujon ..... 4/504
6,598,562 B1 * 7/2003 Dutkiewicz et al. ..... 119/706

* cited by examiner

*Primary Examiner*—S. Joseph Morano
*Assistant Examiner*—Lars A. Olson

(57) ABSTRACT

A device to enable the escape of small animals, for placement at the perimeter of a swimming pool, which is comprised of a length of flexible netting suspended from and weighted by a flexible tube filled with water. The length of netting hangs into the water, floating slightly beneath the surface, enabling the escape or eventual rescue of an animal swimming the perimeter in search of a means of exit.

1 Claim, 2 Drawing Sheets

Scale: 1 inch = 1 foot

Scale: 1 inch = 1 foot

In place

Scale: 1 inch = 1 foot

ESCAPE DEVICE FOR ANIMAL IN SWIMMING POOL

CROSS REFERENCE TO RELATED APPLICATIONS

Not Applicable

STATEMENT RE FEDERALLY SPONSORED RESEARCH OR DEVELOPMENT

Not Applicable

REFERENCE TO SEQUENCE LISTING, TABLE OR COMPUTER PROGRAM LISTING COMPACT DISK APPENDIX

Not Applicable

BACKGROUND OF INVENTION

This invention pertains to the field of swimming pool safety devices, in general, and in particular, to an escape device for small animals attempting to exit a swimming pool after accidental entry.

The water in swimming pools draws small animals, with the common consequence of the animal losing footing and falling in. In an attempt to escape, the animal will swim the perimeter of the pool for a foothold, but finding none, subsequently drowns.

Products already existing for the escape of small animals are constructed of heavy and solid materials, which require permanent or semi-permanent apparatus for attachment to the edge of the pool, and weighted nets to hold the apparatus against the pool side in a vertical Position. As such, they have the potential for damaging the pool liner and coping material. They also pose a hazard to the feet (metal hooks at the pool edge and metal bar suspended under water) and are difficult to reposition and store because of their weight. Metal components also offer the possibility of discoloration of the pool edge. Their complex construction adds to their cost of manufacture, thereby making a reasonable market price beyond what an average pool owner might be willing to invest in such a device. Moreover, the vertical position narrows the available foothold to the animal and increases the likelihood of it floating by.

This invention offers a rescue device that is safe to both pool and swimmers, easily and safely handled and stored, economically available to all pool owners, and more likely to fulfill its intended purpose of rescuing small animals.

BRIEF SUMMARY OF THE INVENTION

Critter Saver is a device constructed of a square of polyethylene mesh attached to a tubular unit made of flexible vinyl, in which the tubular unit is placed outside the pool at a location at the pool's edge and weighted by uncapping a flexible valve, filling with water from a garden hose, then replacing the valve cap. The mesh is then flapped into the pool where it floats slightly beneath the surface in a horizontal or nearly horizontal position. Critter Saver can be placed anywhere on the perimeter of the pool, but will be most effective when placed ahead of the flow of the skimmer, which is determined by observing the motion of the water as it is drawn into the skimmer.

The device in place allows a small animal egress from the pool as the flow of water leads it toward the skimmer where it encounters a foothold provided by the netting. Once on the netting, the animal can either escape on its own by climbing up the net, or be found for rescue.

Because of its construction of soft materials, Critter Saver does not pose a striking hazard to feet either above or below the water surface, neither will it tear, chip or otherwise damage the pool liner or coping. Because of its simplicity of operation, it is easily and safely put in place and taken out of place by anyone, including children. When not filled with water, the device weighs under two pounds and can be easily moved away from the pool surface when not in use. Folded, it takes up less than a square foot of space. It is made of aesthetically pleasing pool-associated colors (greens and blues), and due to its simplicity of manufacture, can be offered at a price less than most pool toys.

BRIEF DESCRIPTION OF SEVERAL VIEWS OF THE DRAWING

The appearance and attributes of Critter Saver can be seen in these drawings.

DETAILED DESCRIPTION OF INVENTION

Figure 1:
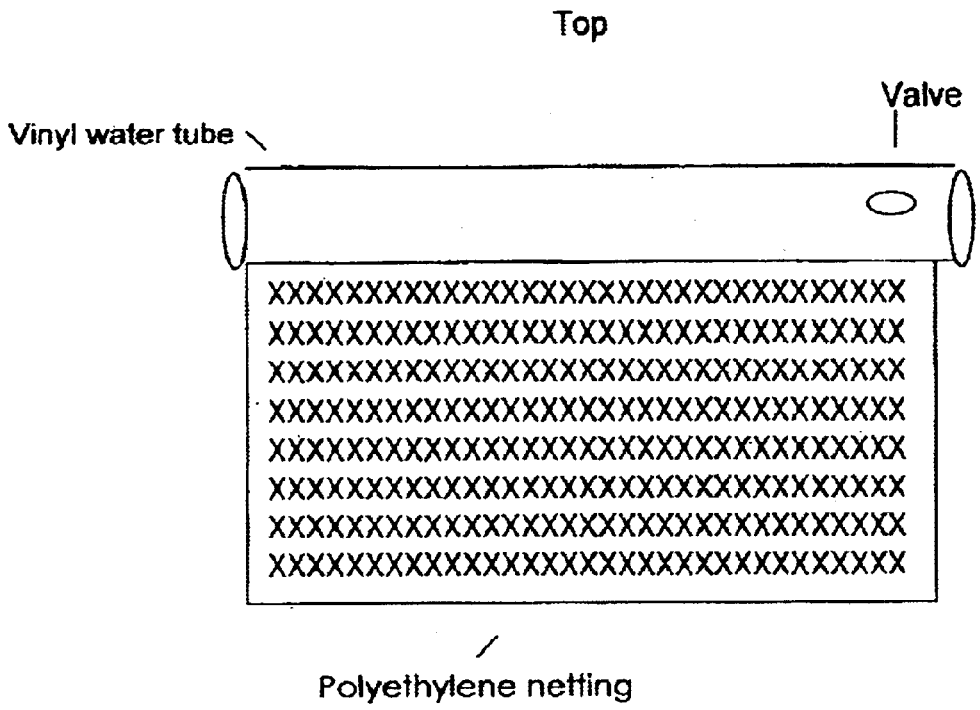
FIG. 1 is a top view of the device when spread on a flat surface.

As seen in the referenced drawing FIG. 1, the Critter Saver is comprised of a three-foot length of finely woven polyethylene flexible netting measuring 44 inches long by 46 inches wide, with a 20 inch casing sewn at one of the long ends. The netting is bound at the three non-casing edges with 1½ inch solid polyethylene flexible binding.

The water tube is made of flexible vinyl and measures 4 feet long by 6 inches in diameter when filled with water. A 2-inch valve with a hinged flip top opening, also vinyl, is found 3 inches from one of the ends.

The device is assembled, as seen in FIG. 1, by grasping one end of the empty water tube and threading it through the casing of the netting, much like inserting an arm into a sleeve, leaving the valve exposed. The Critter Saver is placed near pool edge and filled with water by inserting a garden hose into the valve. After sliding the netting casing over the closed valve, Critter Saver is lifted or slid into place and the netting flapped into the pool.

Figure 2:
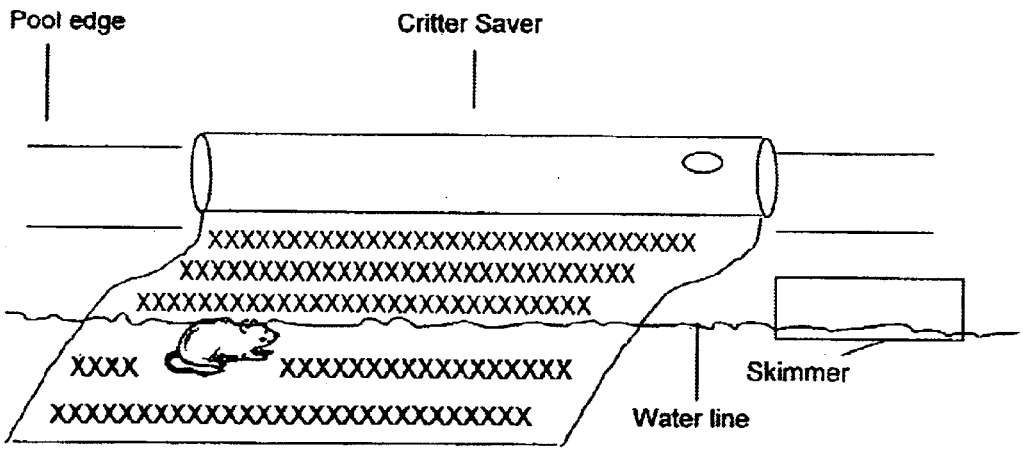
FIG. 2 is the device when in place for use.

FIG. 2 depicts Critter Saver assembled and placed at pool edge.

There is no manufacture involved in Critter Saver. Rather, it is composed of two existing pool-related elements, water tube and flexible netting, which have been manufactured to specifications and combined to create a new product.

I claim:

1. An animal escape device for swimming pools, which is comprised of a flexible water tube that rest at the external perimeter, which has been inserted into a casing attached to a length of flexible netting that extends into and floats slightly on the contained water.

* * * * *